US007120946B1

(12) United States Patent
Lazar

(10) Patent No.: US 7,120,946 B1
(45) Date of Patent: Oct. 17, 2006

(54) BIDET APPARATUS

(76) Inventor: Saurel J. Lazar, 27 Grassmere Rd., Hyde Park, MA (US) 02136

( * ) Notice: Subject to any disclaimer, the term of this patent is extended or adjusted under 35 U.S.C. 154(b) by 239 days.

(21) Appl. No.: 10/921,312

(22) Filed: Aug. 19, 2004

(51) Int. Cl.
*A47K 3/20* (2006.01)
*A47K 4/00* (2006.01)
*E03D 9/08* (2006.01)

(52) U.S. Cl. ..... 4/420.4; 4/420.2

(58) Field of Classification Search ..... 4/420.2, 4/420.4, 420.5, 443, 447
See application file for complete search history.

(56) References Cited

U.S. PATENT DOCUMENTS 3,995,326 A 12/1976 Braun
4,028,745 A 6/1977 Caniglia
4,237,560 A * 12/1980 Riegelman et al. ..... 4/447
5,359,736 A 11/1994 Olivier
5,898,956 A * 5/1999 Kurisaki et al. ..... 4/420.4
5,911,516 A * 6/1999 Chang ..... 4/420.2
6,327,718 B1 * 12/2001 Ono et al. ..... 4/420.2
6,649,884 B1 * 11/2003 Nonomura ..... 219/494
6,754,912 B1 * 6/2004 Hayashi et al. ..... 4/420.2

* cited by examiner

*Primary Examiner*—Charles E. Phillips
(74) *Attorney, Agent, or Firm*—Crossley Patent Law; Mark A. Crossley

(57) ABSTRACT

A bidet apparatus for use with a typical toilet is shown. The bidet apparatus comprises a height-adjustable sub-seat for housing movable liquid and air delivery systems. The air and liquid supplies may be located next to or remotely from the toilet. Controls are fully adjustable for control of on/off, pressure, sub-seat location of liquid and air delivery mechanisms, and temperature and pressure of liquids. Air and liquid delivery systems move out of the way of defecation, urination and the like. A hand-held controller on a flexible stalk provides finger tip control of functions.

17 Claims, 5 Drawing Sheets

BIDET APPARATUS

BACKGROUND

Extensive time, expense, and efforts have been expended in the development of bidet toilets and their related counterparts which are designed to either wash or wash and dry a person's genital area and anus. Needs for such devices may be either needs of convenience or of necessity, such as for use with the physically impaired, or even purely for improved hygiene.

DESCRIPTION OF PRIOR ART

While the prior art is crowded with such devices, there is a failure to address all concerns related to the designs and functions in the general field of bidets. Various designs have addressed some of the needs, such as washing, washing with temperature-regulated water, drying, or soap application. By way of example:

U.S. Pat. No. 4,422,189 to Couvrette discloses a device whose mechanical adjustments are within a case and not immediately accessible and convenient to the user. In addition, the blower/dryer capabilities are limited in that they are peripheral and not movable, therefor not as efficient as direct air.

U.S. Pat. No. 5,359,736 to Olivier discloses a device that requires electrical power to heat water to obtain a comfortable temperature mix for the water used. In this respect and others it differs substantially from the present invention.

U.S. Pat. No. 4,028,745 to Canagilia suggests using existing hot water but has no ready means for mixing cold and hot water and adjusting for correct temperature. The spraying head rotates downward from the user when not in use but does not remove itself from potential contamination by urine or excrement.

U.S. Pat. No. 3,995,326 to Umann discloses a device which is merely a seat and not a complete toilet retrofit apparatus. As such, it requires various mechanical and electrical components from other sources and inventions.

U.S. Pat. No. 4,237,560 to Riegelman et al. Illustrates a device with fixed nozzles and components, all of which are to fit within the toilet seat itself, requiring substantial vertical dimensions. The device is also of considerable complexity.

While the above-described devices fulfill their respective and particular objects and requirements, they do not describe a bidet apparatus that provides for the advantages of the present invention.

Therefore, a need exists for an improved bidet apparatus, particularly one that cumulatively address washing and drying needs, along with soap or medication application, in a simple, cost-effective, user-friendly, fully adjustable, and reliable fashion. In this respect, the present invention substantially departs from the conventional concepts and designs of the prior art.

SUMMARY OF THE INVENTION

In view of the foregoing disadvantages inherent in the known types of bidet toilets now present in the prior art, the bidet apparatus overcomes the abovementioned disadvantages and drawbacks or the prior art. As such, the general purpose of the bidet apparatus, described subsequently in greater detail, is to provide a bidet apparatus which has all of the advantages of the prior art mentioned heretofore and many novel features that result in an improved bidet apparatus which is not anticipated, rendered obvious, suggested, or even implied by the prior art, either alone or in combination thereof.

To accomplish this the bidet apparatus fits onto and adds to an existing toilet. The improved bidet apparatus not only movably washes the anus and genitalia of a user with temperature adjustable water and adjustable water pressure, but also movably dries those and the surrounding areas, and provides for soap or medication dispensation. The invention comprises a device that mounts in place over an existing standard or even custom toilet. The bidet apparatus includes a hand held controller with multiple features which afford the user full adjustment of: washing cycle, drying cycle, soap or medication dispensing, on/off switching, water pressure, and movement of the washing and drying mechanisms. The invention also has height adjustment for versatility in use, and it utilizes existing hot and cold water supplies, as well as standard wall output voltages. The mechanical and electrical components are primarily housed in a control panel containing: a voltage transformer, a microprocessor, twin air blowers, and a switch module, with a soap or medication well located conveniently on the panel. A hot/cold mixing valve is supplied outside of the panel.

From the panel, the air and water lines traverse to the invention's toilet seat housing wherein are fitted the attachments and fixtures for movably washing and drying the user. Alongside the user and flexibly attached is the hand-held controller.

The invention, constructed of plastic, vinyl, injection molding, composite, wood, metal, fiberglass-reinforced plastic, or the like, or any combination thereof, is mounted above and surrounding the bowl of an existing toilet with the toilet seat and cover mounted atop the invention. The height of the invention is adjusted to a position most suitable to the user or users. To the sub-seat of the invention are attached the flexible twin air blower lines, one to either side of the sub-seat or both to one side, and also the flexible mixed water outlet line arriving from the control panel. The tracking assembly mounted within the sub-seat is positioned in an out-of-the-way state prior to typical toilet usage so that the components are kept in a sanitary condition prior to their employment.

In one embodiment, the tracking assembly contains both air and water delivery. In the preferred embodiment, the tracking assembly comprises air delivery only, with the water spray being delivered via a pivoting assembly and a nozzle affixed to its delivery end.

With connections to existing hot and cold water supplies, the mixing valve, located by installers selection, is adjusted either permanently to the desired temperature or, easily and upon desire, changed further either before or during use.

By virtue of the present invention's relatively straightforward design, ease of use, full adjustability, inexpensive components and manufacturing capabilities, lack of extensive space requirements and constraints, completeness, and all-encompassing capability, it can be used by individuals privately or in institutional or hospital environments. The invention can accommodate those who are physically impaired or simply those who wish greater convenience or hygiene.

Thus has been broadly outlined the more important features of the improved bidet apparatus so that the detailed description thereof that follows may be better understood and in order that the present contribution to the art may be better appreciated.

Numerous objects, features and advantages of the improved bidet apparatus will be readily apparent to those of ordinary skill in the art upon reading the following detailed description of presently preferred, but nonetheless illustrative, embodiment of the improved bidet apparatus when taken in conjunction with the accompanying drawings. In this respect, before explaining the current embodiment of the improved bidet apparatus in detail, it is to be understood that the invention is not limited in its application to the details of construction and arrangements of the components set forth in the following description or illustration. The invention is capable of other embodiments and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the improved bidet apparatus. It is therefore important that the claims be regarded as including such equivalent constructions insofar as they do not depart from the spirit and scope of the present invention.

Therefore, it is an object of the bidet apparatus to movably and totally wash and dry the anus and genitalia of a user.

An additional object of the bidet apparatus is to provide pivotal water delivery.

Another object of the bidet apparatus is to totally dry the anus and genitalia of a user.

It is yet another object of the bidet apparatus to provide height adjustment.

Still another object of the bidet apparatus is to provide movable hand accessible controls.

Yet another object of the bidet apparatus is to provide control of water pressure.

It is a further object of the bidet apparatus to utilize existing hot and cold water sources, thereby negating the need for additional heating mechanisms and water storage.

Still a further object of the bidet apparatus is to provide for mixing of hot and cold water sources.

It is another object of the bidet apparatus to provide for full functions from existing electrical outputs and voltages.

An additional object of the bidet apparatus is to provide washing and drying mechanisms that are out of the way of soiling during toilet usage.

A further object of the bidet apparatus is to provide for soap or medication storage snd dispensing.

And, it is an object of the bidet apparatus to provide for fit on and about an existing toilet.

These together with additional objects of the improved bidet apparatus, along with various novel features that characterize the invention are particularly pointed out in the claims forming a part of this disclosure. For better understanding of the improved bidet apparatus, its operating advantages and specific objects attained by its uses, refer to the accompanying drawings and description.

DETAILED DESCRIPTION OF DRAWINGS

With reference now to the drawings, and in particular FIGS. 1 through 6 thereof, the preferred embodiment of the improved bidet apparatus employing the principles and concepts of the present invention and generally designated by the reference number 10 will be described.

Figure 1:
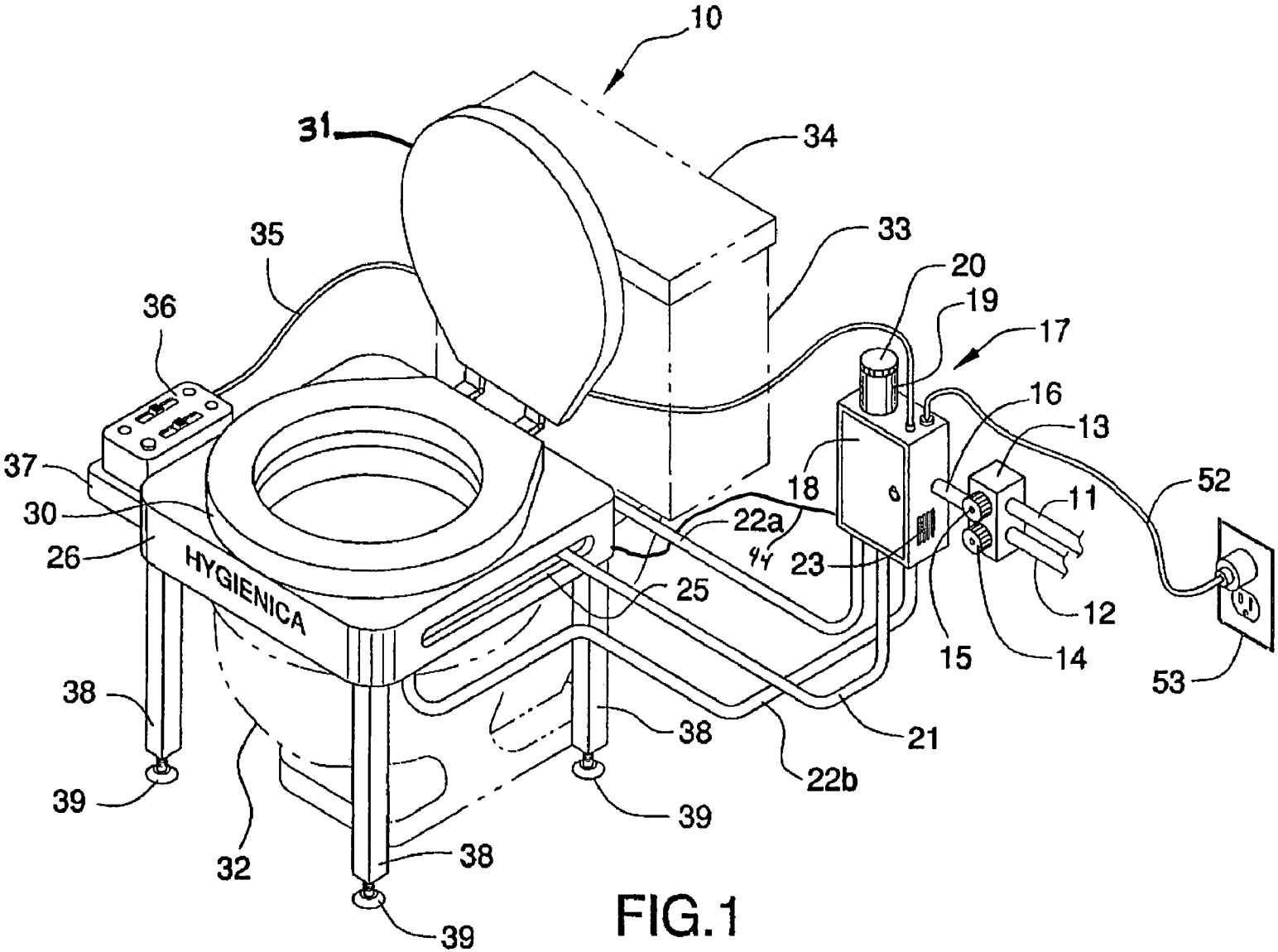
FIG. 1 is a perspective view of the bidet apparatus installed on and around an existing toilet.

Referring to FIG. 1, sub-seat 26 of invention 10 is placed over a toilet bowl 32. Control panel 17 (FIG. 1 and FIG. 5) is mounted by typical fastening means in the desired position, and plugged into an existing electrical wall outlet 53 via plugged electrical input cord 52. Hot water supply 11 and cold water supply 12 are attached to existing water sources (not shown). Supply 11 and supply 12 are adjusted to desired pressure and temperature via hot adjusting knob 15 and cold adjusting knob 14 housed within hot/cold valve assembly 13. Assembly 13 feeds flexible mixed inlet water line 16. Sub-seat 26 is supported in the desired position by legs 38. Sub-seat 26 height is adjusted by turning leg adjusting bolts 39, each of which is attached at the bottom of each leg 38. Typical toilet seat 30 hinges upon sub-seat 26. Existing cistern 33 and cistern lid 34 remain on bowl 32 in original positions. User (not shown) of bidet 10 lifts toilet seat lid 31 to sit on toilet seat 30.

Figure 5:
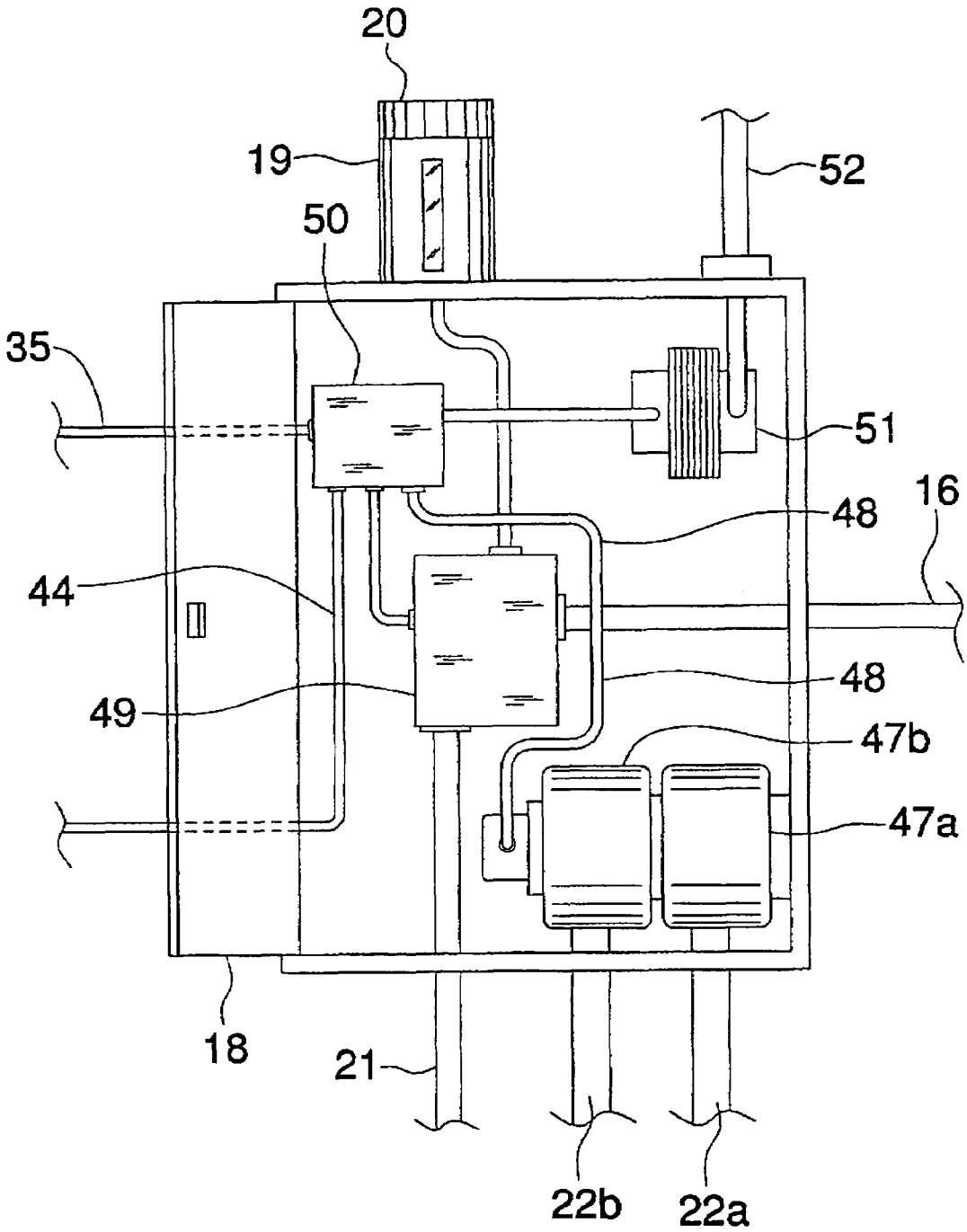
FIG. 5 is a frontal, internal view of the control panel.

Referring to FIG. 5, panel 17 is electrically powered by cord 52 to electrical transformer 51 accessibly located within panel 17, as are other internal components of panel 17, for replacement or repair. Access within panel 17 is through control panel access door 18 (FIG. 1). Microprocessor 50 within panel 17 is powered by electrical transformer 51. Electrical commands from hand-held controller 36 (FIG. 1 and FIG. 6) signal microprocessor 50 to perform bidet apparatus 10 functions. Functions inherent to controller 36, which rests by user selectivity either on or off of hand-held controller platform 37, include on/off button 56, soap or medication dispensing button 55, drying cycle button 59, liquid activation and pressure control knob 54, dispensing pivot control 57, and tracking assembly control 58.

Electrical commands from controller 36 transmit via flexible conduit 35 to panel 17 (FIG. 5) where dictated functions are transmitted to switch module 49 via microprocessor 50. Module 49 controls hot/cold water mix pressure delivered to flexible liquid delivery line 21. Module 49 also controls soap/medication well 19 covered by threadably attached well cap 20, tracking assembly 27, blowers 47*a* and 47*b*, pivot motor 60, and reversible electric motor 61. Sub-seat power feed 44 directs sub-seat 26 functions' commands from micro processor 50.

Line 21 supplies pivoting arm assembly 63 which pivots in a horizontal plane equal to that of seat 30. Motor 60 turns pivot belt 64 to control assembly 63 via dispensing pivot control 57 within hand-held controller 36. Assembly 63 thereby positions liquid nozzle 29 to position desired by user.

Figure 2:
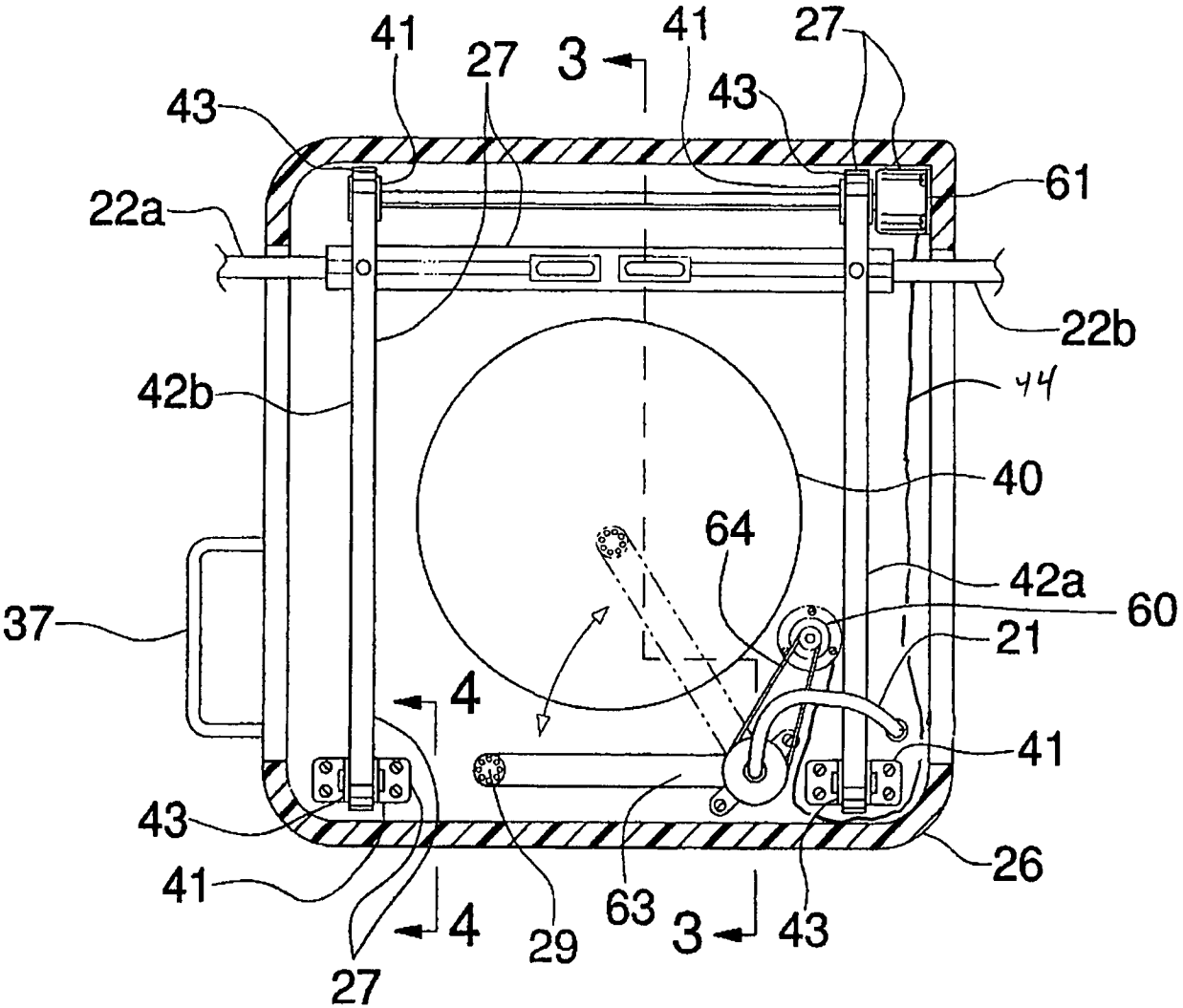
FIG. 2 is a bottom view of the sub-seat of the bidet apparatus.
Figure 3:
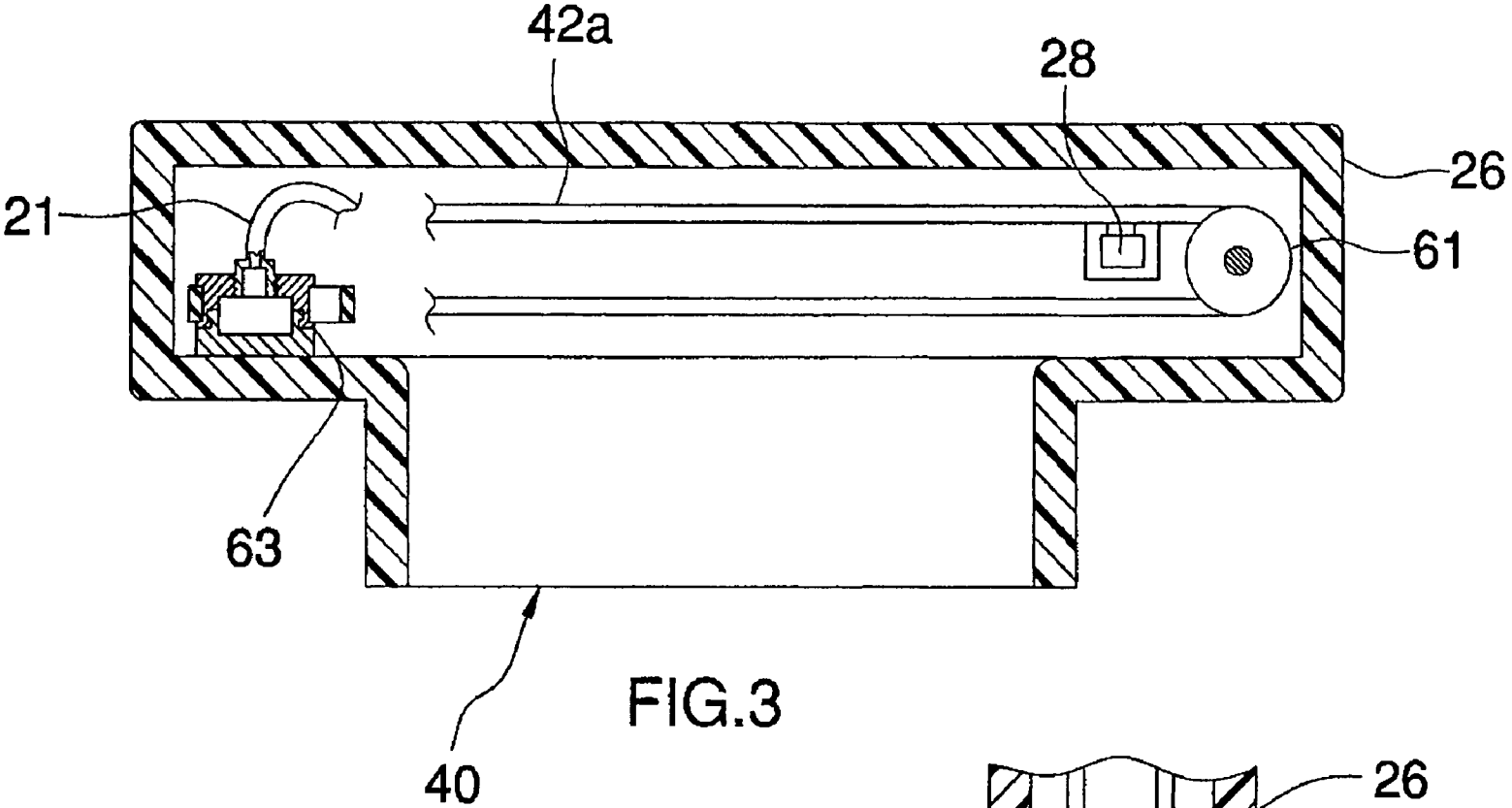
FIG. 3 is a lateral cutaway view of part of the tracking assembly and water pivot of the sub-seat.
Figure 4:
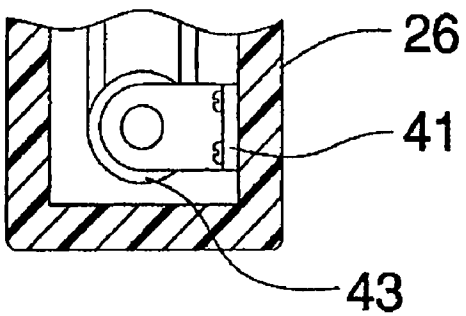
FIG. 4 is a side view of a pulley of the tracking assembly.

Referring to FIG. 5 and FIG. 2, microprocessor 50 signals, by way of electrical power to air blower 48, air blowers 47*a* and 47*b* that deliver air obtained through air blower intake 23 (FIG. 1). Air is delivered to tracking assembly 27 via flexible air supply lines 22*a* and 22*b*. Lines 22*a* and 22*b* are connected to opposing sides of tracking assembly 27. Assembly 27 is housed within sub-seat 26, and fore and aft operation are provided by way of lateral opening for tracking assembly 25. Air to assembly 27 is delivered to user of bidet 10 through air channel 28 (FIG. 3).

Tracking assembly 27 is mounted via typical means to underside of sub-seat 26 via a plurality of tracking assembly mounts 41. Reversible electric motor 61, commanded by on/off button 56 and tracking assembly control 58 of controller 36 (FIG. 6), is engaged to move air channel 28 to the desired position under sub-seat opening 40. Tracking is accomplished via a plurality of tracking assembly pulleys 43 and tracking assembly belts 42*a* and 42*b*.

Figure 6:
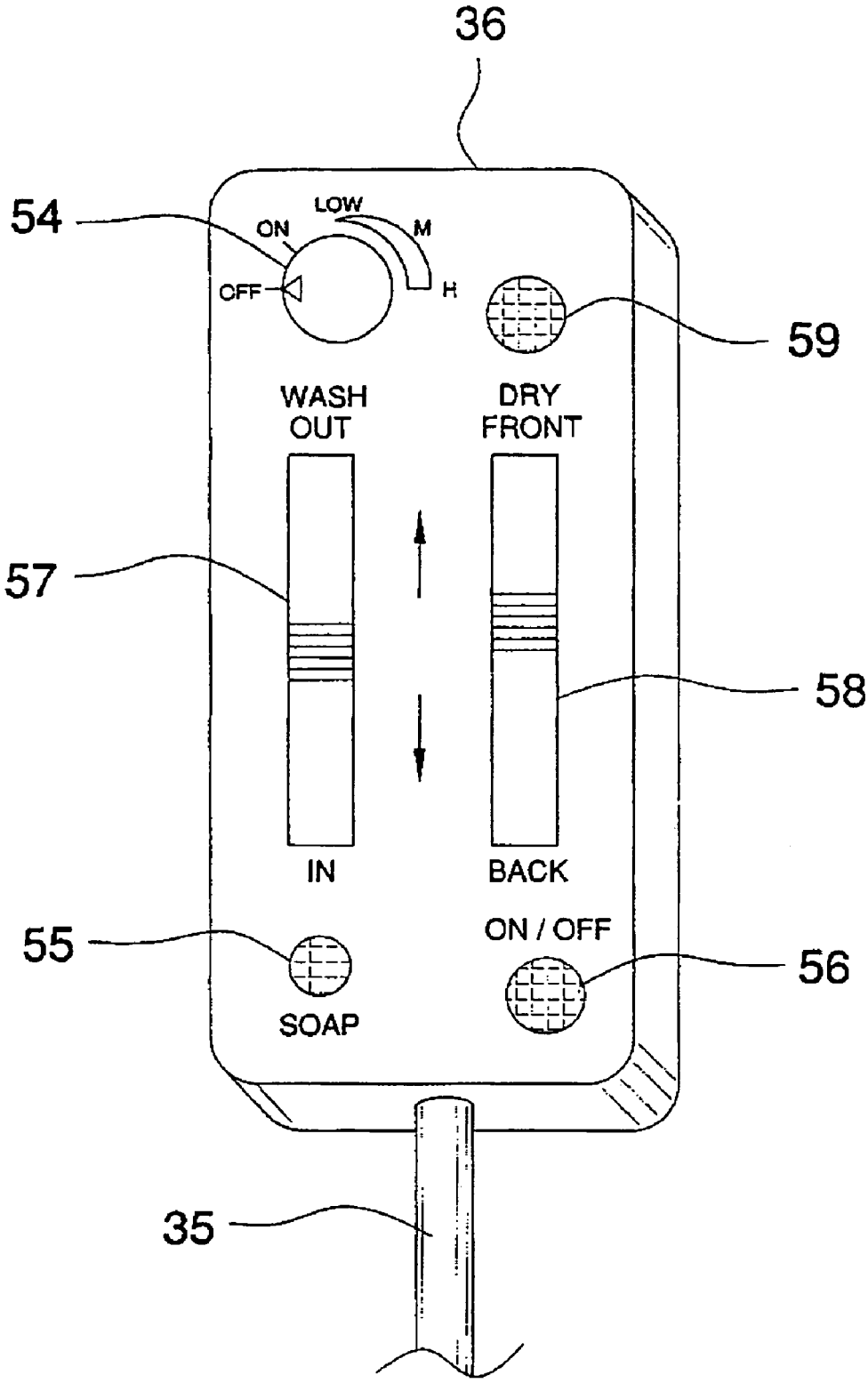
FIG. 6 is a perspective view of the hand-held controller.

Referring to FIG. 1, user sits on toilet seat 30 resting atop sub-seat 26 (FIG. 1) of invention 10, and thereafter either actually uses the toilet as they normally would or engages the cleaning mechanisms of the bidet 10. A user or user's aid may adjust the height of bidet 10 via leg adjusting bolts 39 that are rotatably affixed to legs 38. The user utilizes the tracking assembly control 58 of the hand-held controller 36 (FIG. 6) to position air channel 28 (FIG. 2 and FIG. 3) out of the way of defecation, urination or the like. User may also pivot liquid nozzle 29 out of way of toileting by way of dispensing pivot control 57. Referring to FIG. 6, pressure control knob 54 of hand-held controller 36 provides user adjustment for liquid pressure. Controller 36 rests either on platform 37 or is held in user's hand. Controller 36 is flexibly attached via flexible conduit 35 from control panel 17 (FIG. 1, FIG. 5 and FIG. 6). User pivots nozzle 29 to desired position via dispensing pivot control 57 of controller 36 (FIG. 6). Control 57 directs motor 60 to move assembly 63.

Liquid activation and pressure control knob 54 initiates the water spraying function and controls pressure. Water originating from the inlet hot 11 and cold 12 water lines enters the control panel 17 after first flowing through the hot/cold valve assembly 13. Water leaves panel 17 via flexible liquid delivery line 21. Line 21 connects to pivoting arm 63 within sub-seat 26 (FIG. 2). Water, medication, or soap sprays from liquid nozzle 29. Water temperature is not only available for setting prior to usage, but also during use, by turning cold adjusting knob 14 and hot adjusting knob 15 (FIG. 1). Soap or medication dispensing button 55 of controller 36 directs microprocessor 50 to appropriately signal switch module 49 to control soap/medication well 19. Soap or medication (not shown) is added to water at any time chosen by user. Threadably attached well cap 20 accesses well 19 for filling.

User pivots assembly 63 back out of way after use via control 57. When the user or the user's aid (not shown) has completed the liquid cycle, the drying cycle of the invention 10 is initiated by drying cycle button 59 of the hand-held controller 36 shown in FIG. 1 and FIG. 6. Fore and aft tracking assembly control 58 of controller 36 (FIG. 6) moves air channel 28 into and through positions for drying user.

Drying cycle button 59 instructs microprocessor 50 (FIG. 5) to actuate twin blowers 47*a* and 47*b* to supply drying air drawn by blowers 47*a* and 47*b* through air blower intake 23 (FIG. 1).

Tracking assembly 27 (FIG. 2 and FIG. 3) is controlled by control 58 of hand-held controller 36 (FIG. 6) for fore and aft movement in the same horizontal plane as toilet seat 30 (FIG. 1). Upon cessation of use of invention 10, a user or their aid returns tracking assembly 27 (FIG. 2) to an out of way position.

With respect to the above description then, it is to be realized that the optimum dimensional relationships for the parts of the improved bidet apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A bidet apparatus for use in combination with a typical toilet, the bidet apparatus comprising a generally parallelepiped sub-seat disposed between a seat and a bowl of the typical toilet, the sub-seat further comprising:

air delivery means moveably mounted within the sub-seat;

liquid delivery means moveably mounted below the sub-seat;

means for pivoting the liquid delivery means, the pivoting means disposed within the sub-seat;

means for moving the air delivery means, the moving means disposed within the sub-seat; and the bidet apparatus further comprising:

a control panel mounted to a wall proximal to the toilet;

air supply means contained within the control panel, the air supply means flexibly connected to the air delivery means;

liquid supply means attached to the control panel, the liquid supply means flexibly connected to the liquid delivery means;

a microprocessor controller is contained within the control panel, the microprocessor controls the air delivery means, the air supply means, the liquid delivery, the liquid supply means, liquid delivery pivot means, and the air delivery movement means;

a remote hand held controller is in communication with the microprocessor for selectively controlling the microprocessor:

means for powering the microprocessor.

2. The invention in claim 1 wherein the movement means for the air delivery means further comprises a sub-seat tracking assembly located within and below the sub-seat, the sub-seat tracking assembly further comprising a movable air channel.

3. The invention in claim 2 wherein the powering means further comprises an electric power transformer.

4. The invention in claim 3 wherein the liquid delivery means further comprises a liquid nozzle on a pivoting arm assembly mounted within the sub-seat, the pivoting arm moved by a pivot motor affixed to the sub-seat and a pivot belt attached to the motor and the pivot arm.

5. The invention in claim 4 wherein the air supply means for the air delivery means comprises at least one electric air pump.

6. The invention in claim 5 wherein the liquid supply means further comprises a a hot/cold water valve assembly is flexibly attached to a switch module contained within the control panel, the assembly supplying temperature and pressure adjusted water to the switch module, and the switch module controls the liquids supplied to the liquid delivery means.

7. The invention in claim 6 wherein the hot/cold valve assembly is manually adjustable by knobs located on an external surface of the assembly.

8. The invention in claim 7 wherein the liquid supply means further comprises a soap/medication well.

9. The invention in claim 8 wherein the sub-seat tracking assembly further comprises more than one pulley and at least one belt for fore and aft movement of the air channel.

10. The invention in claim 9 wherein the sub-seat is height adjustable.

11. The invention in claim 10 wherein the hand-held controller further comprises controls for on/off operation of the air supply, position of the sub-seat tracking assembly, dispensing button for the soap/medication well, position of the pivoting arm assembly, and a liquid activation and pressure control knob.

12. A bidet apparatus for use in combination with a typical toilet, the bidet apparatus comprising a generally parallelepiped sub-seat disposed between a seat and a bowl of the typical toilet, the sub-seat further comprising:

air delivery means mounted to the sub-seat, the air delivery means comprised of a sub-seat tracking assembly and an air channel, the sub-seat tracking assembly further comprised of more than one pulley and at least one belt; the sub-seat tracking assembly powered by an electric motor;

liquid delivery means mounted below the sub-seat, the liquid delivery means comprised of a liquid nozzle on a pivoting arm assembly pivoted by an electric motor and a belt; and the bidet apparatus further comprising:

air supply means flexibly supplying the air delivery means, the air supply means comprised of at least one electric air blower;

liquid supply means flexibly supplying the liquid delivery means, the liquid supply means comprising a hot water supply and a cold water supply, both supplying a hot/cold valve assembly for controlling the hot water supply and the cold water supply;

electrical control means for the air supply means, the air delivery means, the liquid supply means, and the liquid delivery means, wherein the control means further comprises a control panel directed by a flexibly connected movable controller.

13. The invention in claim 12 wherein the sub-seat assembly is height adjustable.

14. The invention in claim 13 wherein the air supply means and the liquid supply means are located remotely from the sub-seat assembly.

15. The invention in claim 14 wherein the sub-seat tracking assembly moves the air delivery means fully out of the path of excrement.

16. The invention in claim 15 wherein the pivoting arm assembly pivots the liquid nozzle fully out of the path of excrement.

17. The invention in claim 16 wherein the liquid supply means further comprises a soap/medication well.

* * * * *